US006636131B2

(12) United States Patent
Hattori

(10) Patent No.: US 6,636,131 B2
(45) Date of Patent: Oct. 21, 2003

(54) METHOD FOR MANUFACTURING FILTER USING COUPLING COEFFICIENT FUNCTION

(75) Inventor: Wataru Hattori, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/146,807

(22) Filed: May 17, 2002

(65) Prior Publication Data

US 2002/0171515 A1 Nov. 21, 2002

(30) Foreign Application Priority Data

May 21, 2001 (JP) ..... 2001-151557

(51) Int. Cl.[7] ..... H01P 3/08; H01P 1/203
(52) U.S. Cl. ..... 333/204; 333/238; 333/219
(58) Field of Search ..... 333/202, 204, 333/205, 219, 246, 238, 210

(56) References Cited

U.S. PATENT DOCUMENTS 4,701,727 A * 10/1987 Wong ..... 333/204
6,130,189 A * 10/2000 Matthaei ..... 505/210

* cited by examiner

*Primary Examiner*—Robert Pascal
*Assistant Examiner*—Dean Takaoka
(74) *Attorney, Agent, or Firm*—Sughrue Mion, PLLC

(57) ABSTRACT

In a method for manufacturing a filter including a plurality of resonators arranged in series, a shape of the resonators and a number of the resonators are determined, so that an amount of additional coupling coefficients between the resonators except for two adjacent ones of the resonators is smaller than a predetermined value. Then, an initial coupling coefficient function is calculated with respect to a distance between two adjacent ones of the resonators, and is set in a coupling coefficient function. Then, coupling coefficients between the resonators are calculated for desired filter frequency responses, and distances between the resonators having the calculated coupling coefficients are calculated in accordance with the coupling coefficient function. Then, a layout of the filter having the resonators with the calculated distances is designed, and a tentative filter is manufactured. Then, it is determined whether or not filter frequency responses of the tentative filter satisfy the desired filter frequency responses. When the filter frequency responses of the manufactured filter satisfy the desired filter frequency responses, actual filters are manufactured by using the layout. Otherwise, the coupling coefficient function is changed, thus repeating the distance calculating step, the layout designing step and the filter frequency responses determining step.

12 Claims, 6 Drawing Sheets

METHOD FOR MANUFACTURING FILTER USING COUPLING COEFFICIENT FUNCTION

BACKGROUND OF THE INVENTION

1. Field of the Invention

The present invention relates to a method for manufacturing a filter, and more particularly, to a method for manufacturing a microwave bandpass filter including a plurality of microstrip resonators arranged in series.

2. Description of the Related Art

Generally, in communication apparatuses, microwave filters have been developed. A typical microwave filter is constructed by a dielectric substrate, a ground plane formed on a back surface of the dielectric substrate, and a plurality of microstrip conductors arranged in series on a front surface of the dielectric substrate, so that a plurality of microstrip resonators are formed in series.

In a prior art method for manufacturing a filter, basic parameters such as a shape of the microstrip resonators, the number of the microstrip resonators and the like are determined. Then, coupling coefficients are calculated to satisfy desired frequency responses of the filter. Then, the coupling coefficients are converted into distances, in accordance with an experimental relationship between a distance between two resonators and a coupling coefficient between the two resonators. Then, a layout for the filter is designed by using the basic parameters and the obtained distances, and the filter is manufactured in accordance with the layout. Then, it is determined whether or not the frequency responses of the filter satisfy the desired frequency responses.

When the frequency responses of the filter do not satisfy the desired frequency responses, a laser trimming operation is performed upon some of the resonators, or tuning screws provided above the resonators are adjusted, thus repeating the determination of the frequency responses of the filter. This will be explained later in detail.

In the above-described prior art manufacturing method, however, since the frequency responses or the filter after the adjustment are non-linear, it is difficult for the obtained frequency responses of the filter to be converged into the desired frequency responses. At worst, the obtained frequency responses are further deviated from the desired frequency responses, which may make it necessary to redetermine the basic parameters.

Also, the above-mentioned laser trimming operation or the adjustment of tuning screws needs to be performed upon each manufactured filter, which would remarkably increase the manufacturing cost.

Thus, the manufacturing cost is increased.

SUMMARY OF THE INVENTION

It is an object of the present invention to provide a method for manufacturing a filter capable of decreasing the manufacturing cost.

According to the present invention, in a method for manufacturing a filter including a plurality of resonator arranged in series, a shape of the resonators and a number of the resonators are determined, so that an amount of additional coupling coefficients between the resonators except for two adjacent ones of the resonators is smaller than a predetermined value. Then, an initial coupling coefficient function is calculated with respect to a distance between two adjacent ones of the resonators, and is set in a coupling coefficient function. Then, coupling coefficients between the resonators are calculated for desired filter frequency responses, and distances between the resonators having the calculated coupling coefficients are calculated in accordance with the coupling coefficient function. Then, a layout of the filter having the resonators with the calculated distances is laid out and a tentative filter is manufactured. Then, it is determined whether or not filter frequency responses of the tentative filter satisfy the desired filter frequency responses. Only when the filter frequency responses of the tentative filter satisfy the desired filter frequency responses, are actual filters manufactured by using the above-mentioned layout. Otherwise, the coupling coefficient function is changed, thus repeating the distance calculating step, the layout designing step and the filter frequency responses determining step.

Since the coupling coefficient function is changed step by step, the frequency responses of the filter can be easily converged into the desired frequency responses.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENT

Before the description of the preferred embodiment, a prior art method for manufacturing a microwave bandpass filter will be explained with reference to FIGS. 1 and 2.

Figure 1:
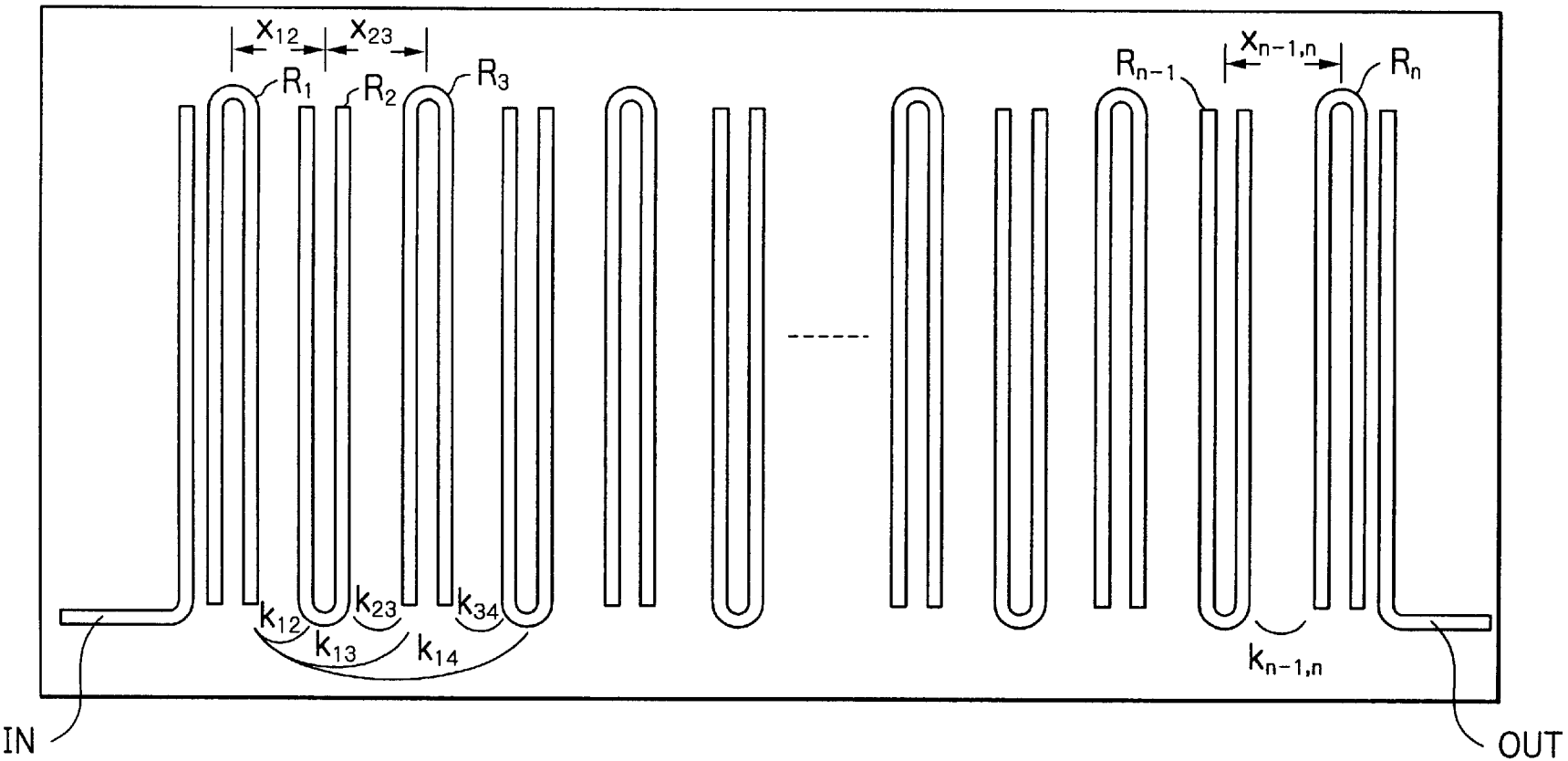
Fig. 1 PRIOR ART
FIG. 1 is a plan view illustrating a typical microwave bandpass filter.

In FIG. 1, which illustrates a typical microwave bandpass filter, microstrip resonators $R_1, R_2, \ldots, R_n$ are arranged in series between an input terminal IN and an output terminal OUT. In this case, $k_{ij}$ designates a coupling coefficient between the microstrip resonators $R_i$ and $R_j$. The coupling coefficients $k_{12}, k_{13}, \ldots, k_{23}, k_{24}, \ldots, k_{n-1,n}$ depend upon distances $x_{12}, x_{13}, \ldots, x_{23}, x_{24}, \ldots, x_{n-1,n}$ between the microstrip resonators $R_1, R_2, \ldots, R_n$. Generally, the larger the distance such as $X_{12}$, the smaller the corresponding coupling coefficient such as $k_{12}$. Also, one main coupling coefficient such as $k_{12}$ between two adjacent microstrip resonators such as $R_1$ and $R_2$ is much larger than additional coupling coefficients such as $k_{13}, k_{14}$, between non-adjacent microstrip resonators.

A prior art method for manufacturing the microwave bandpass filter of FIG. 1 will be explained next with reference to FIG. 2.

First, at step 201, basic parameters such as a shape of each of the microstrip resonators $R_1, R_2, \ldots, R_n$, the number n of the microstrip resonators $R_1, R_2, \ldots, R_n$, and the like are determined.

Next, at step 202, coupling coefficients $k_{12}, k_{22}, \ldots, k_{n-1,n}$ are calculated to satisfy the desired bandpass frequency responses of the filter.

Next, at step 203, the coupling coefficients $k_{12}, k_{23}, \ldots, k_{n-1,n}$ are converted into distances $x_{12}, x_{23}, \ldots, X_{n-1,n}$, respectively, in accordance with a relationship between a distance between two resonators and a coupling coefficient between the two resonators.

The above-mentioned distance-to-coupling coefficient relationship can be experimentally obtained in advance. In this case, the error of the coupling coefficient is expected to be on the order of $10^{-2}$. Besides, the above-mentioned distance-to-coupling coefficient relationship can be determined by a computer-aided three-dimensional electromagnetic simulation in advance. Also, in this case, the error of the coupling coefficient is expected to be on the order of $10^{-2}$.

Next, at step 204, a layout for the microwave bandpass filter is designed by using the basic parameters determined at step 201 and the distances $x_{12}, x_{23}, \ldots, X_{n-1,n}$ obtained at step 203.

Next, at step 205, the microwave bandpass filter is manufactured in accordance with the layout obtained at step 204.

Next, at step 206, it is determined whether or not the bandpass frequency responses of the microwave bandpass filter manufactured at step 205 satisfy the desired bandpass frequency responses. Only when the bandpass frequency responses of the manufactured microwave bandpass filter satisfy the desired bandpass frequency responses, does the process proceed to step 208, thus completing the flowchart of FIG. 2. Otherwise, the process proceeds to step 207. Note that the desired bandpass frequency responses have a tolerance.

At step 207, a laser trimming operation is performed upon some of the resonators $R_1, R_2, \ldots, R_n$, or screws provided above the resonators $R_1, R_2, \ldots, R_n$ are adjusted. Then, the process at step 206 is repeated.

Thus, generally, the processes at steps 206 and 207 are repeated until the bandpass frequency responses of the filter satisfy the desired bandpass frequency responses.

Figure 2:
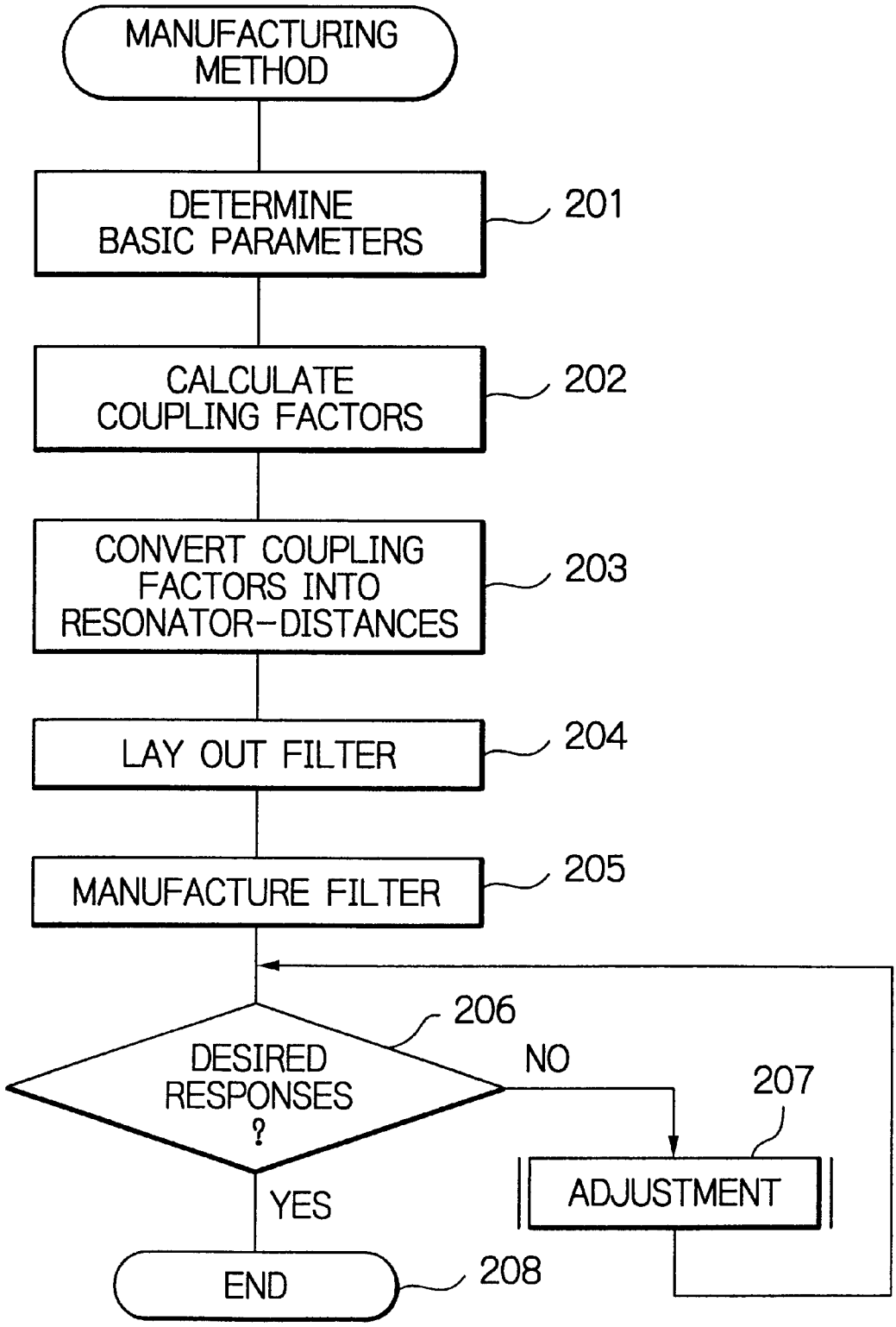
Fig. 2 PRIOR ART
FIG. 2 is a flowchart for explaining a prior art method for manufacturing the microwave bandpass filter of FIG. 1.

In the manufacturing method as illustrated in FIG. 2, however, since the bandpass frequency responses or the filter after the adjustment at step 207 are non-linear, it is difficult for the obtained bandpass frequency responses of the filter to be converged into the desired bandpass frequency responses. At worst, the obtained bandpass frequency responses are further deviated from the desired bandpass frequency responses, which may make it necessary to redetermine the basic parameters.

Also, the above-mentioned laser trimming operation or the adjustment of tuning screws needs to be performed upon each manufactured filter, which would remarkably increase the manufacturing cost.

Thus, the manufacturing cost is increased.

Particularly, microwave bandpass filters made of high-temperature superconductor have recently been developed. Such a microwave bandpass filter is constructed by ten or more multi-pole microstrip resonators to realize a high Q-factor, so that the error of a coupling coefficient between two of the resonators is expected to be on the order of $10^{-4}$. If the manufacturing method as illustrated in FIG. 2 is applied to the manufacture of the above-mentioned microwave bandpass filters, the manufacturing cost is further increased.

An embodiment of the method for manufacturing a microwave bandpass filter according to the present invention will be explained next with reference to FIGS. 3, 4 and 5.

Figure 3:
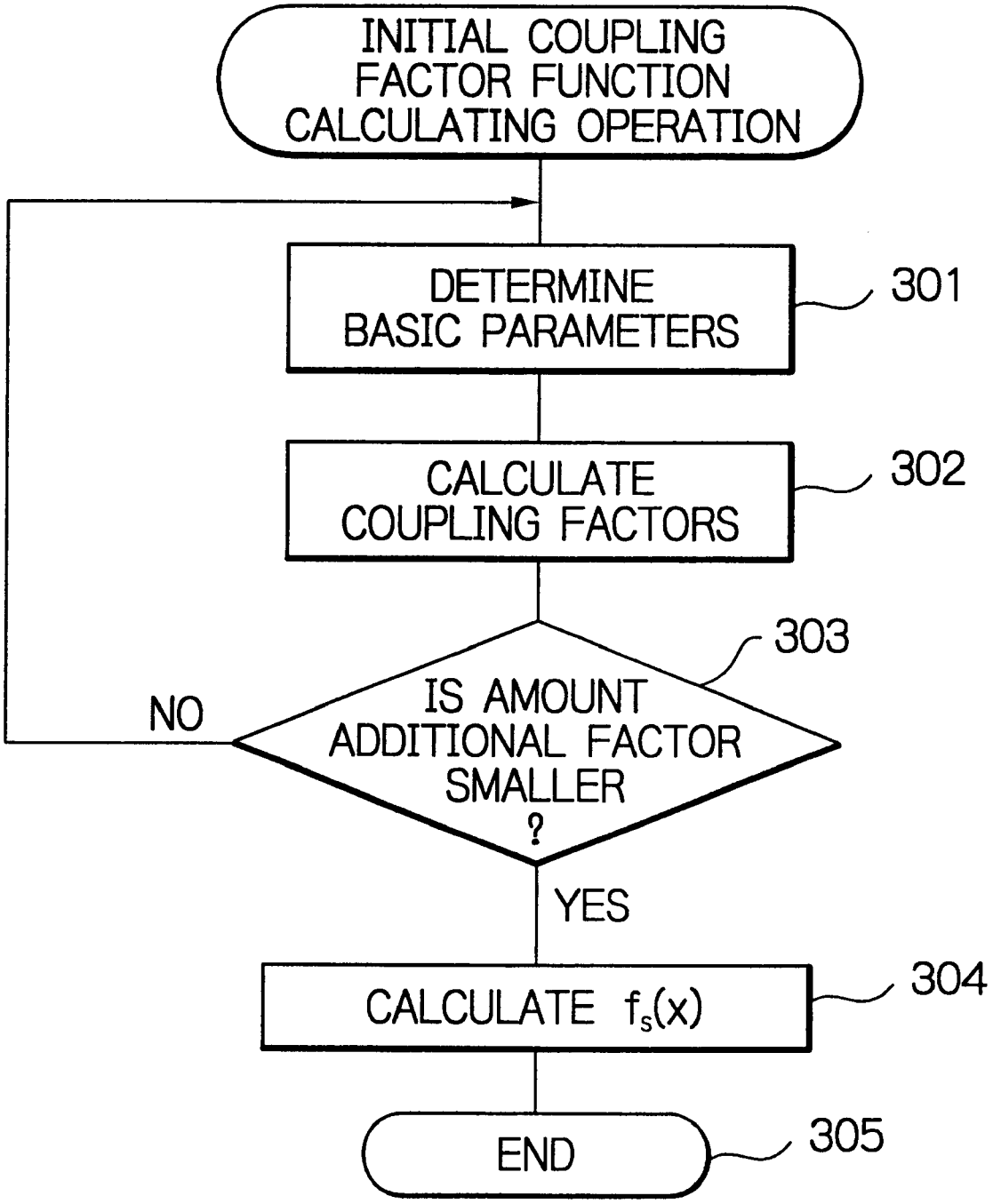
FIGS. 3 and 4 are flowcharts for explaining an embodiment of the method for manufacturing a microwave bandpass filter according to the present invention.

FIG. 3 is a flowchart for calculating an initial coupling coefficient function $f_s(x)$ with respect to a distance x between microstrip resonators.

First, at step 301, basic parameters such as a shape of each of the microstrip resonators $R_1, R_2, \ldots, R_n$, the number n of the microstrip resonators $R_1, R_2, \ldots, R_n$, and the like are determined. In this case, the center frequency of a microwave bandpass filter decided by that of the microwave resonators is brought close to that of desired bandpass frequency responses and is expected to show a high Q-factor.

Next, at step 302, not only main coupling coefficients $k_{12}, k_{23}, \ldots, k_{n-1,n}$ but additional coupling coefficients $k_{13}, k_{14}, \ldots, k_{24}, k_{25}, \ldots$ are calculated in accordance with the distances x between the microstrip resonators $R_1, R_2, \ldots, R_n$ by using a three-dimensional electromagnetic simulation such as Momentum of Agilent Technologies, Inc. and IE3D of Zeland Software, Inc. Note that the error of the calculated coupling coefficients obtained by such a three-dimensional electromagnetic simulation is conventionally expected to be $10^{-2}$.

Next, at step 303, it is determined whether or not an amount T of the additional coupling coefficients is smaller than a predetermined value. For example, it is determined whether or not $$T=|k_{13}|+|k_{14}|+\ldots+|k_{1n}|$$
$$<C_1\cdot|k_{12}|$$

where $C_1$ is ⅕ to 1/10 or less.

When the amount T of the additional coefficients is not smaller than the predetermined value, the processes at steps 301, 302, 303 are repeated until the amount T of the additional coefficients is smaller than the predetermined value. On the other hand, when the amount T of the additional coefficients is smaller than the predetermined value, the process proceeds to step 304.

Figure 5:
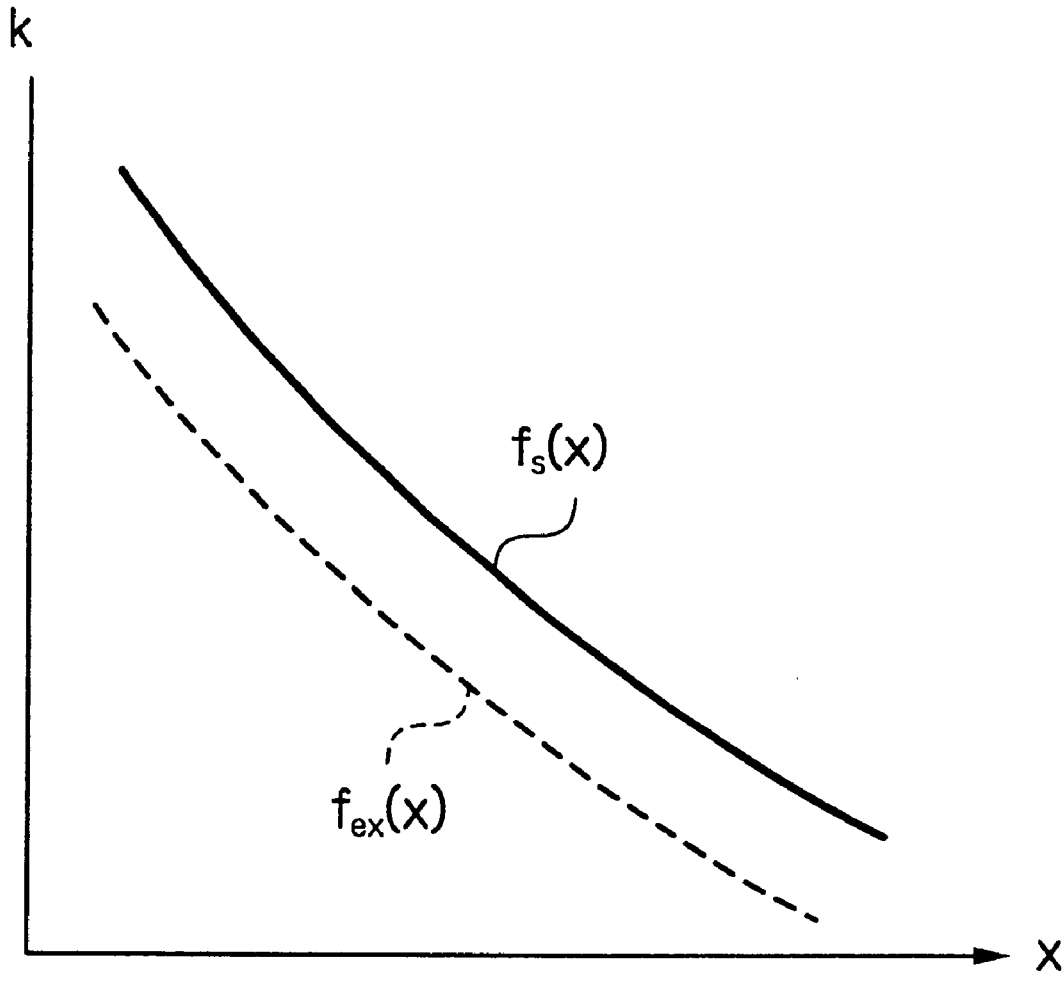
FIG. 5 is a graph showing the coupling coefficient function of FIG. 4.

At step 304, an initial coupling coefficient function $f_s(x)$ as shown in FIG. 5 is calculated with respect to the distance x between the microstrip resonators such as $R_1$ and $R_2$ by using the above-mentioned two-dimensional electromagnetic simulation.

Thus, the flowchart of FIG. 3 is completed by step 305.

Figure 4:
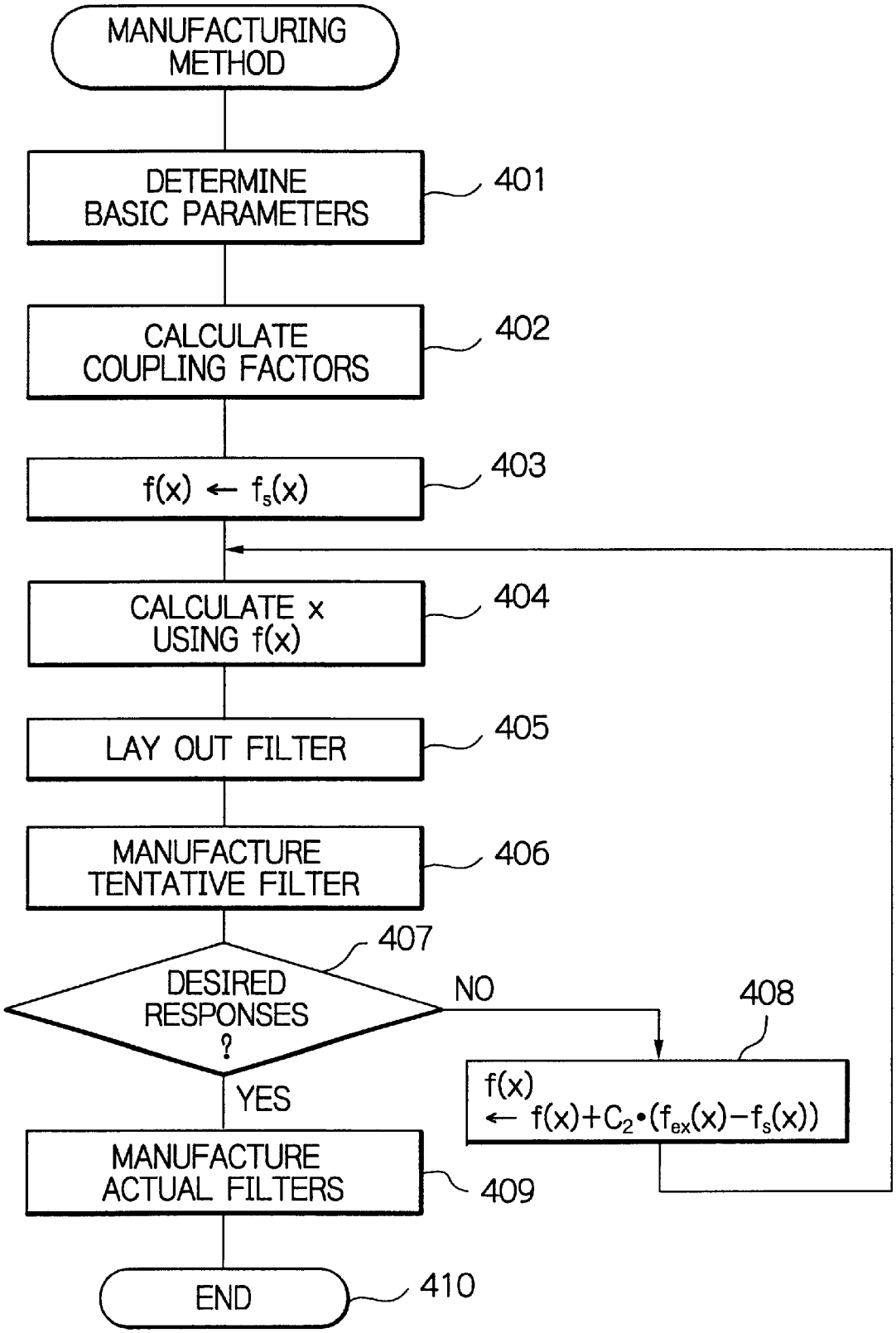

FIG. 4 is a flowchart for explaining a method for manufacturing the microwave bandpass filter of FIG. 1 using the initial coupling coefficient function $f_s(x)$ obtained by the flowchart of FIG. 3. Note that an experimental coupling coefficient $f_{ex}(x)$ is experimentally obtained in advance by actually manufacturing a microwave bandpass filter similar to the microwave bandpass filter of FIG. 1 which does not always satisfy the desired bandpass frequency responses.

First, at step 401, basic parameters such as a shape of each of the microstrip resonators $R_1, R_2, \ldots, R_n$, the number n of the microstrip resonators $R_1, R_2, \ldots, R_n$, and the like are determined.

Next, at step 402, coupling coefficients $k_{12}, k_{23}, \ldots, k_{n-1,n}$ are calculated to satisfy the desired bandpass frequency responses.

Next, at step 403, a coupling coefficient function f(x) is set by the initial coupling coefficient function $f_s(x)$:

$$f(x)\leftarrow f_s(x)$$

Next, at step 404, distances $x_{12}, x_{23}, \ldots, X_{n-1,n}$ between the microstrip resonators $R_1, R_2, \ldots, R_n$ are calculated by using the coupling coefficient function f(x) and the coupling coefficients $k_{12}, k_{23}, \ldots, k_{n-1,n}$ obtained at step 402:

$$x_{12}\leftarrow f^{-1}(k_{12})$$
$$x_{23}\leftarrow f^{-1}(k_{23})$$
$$\vdots$$
$$x_{n-1,n}\leftarrow f^{-1}(k_{n-1,n})$$

Next, at step 405, a layout for the microwave bandpass filter is designed by using the basic parameters determined at step 401 and the distances $x_{12}, x_{23}, \ldots, X_{n-1,n}$ obtained at step 404.

Next, at step 406, a tentative microwave bandpass filter is manufactured in accordance with the layout obtained at step 405.

Next, at step 407, it is determined whether or not the bandpass frequency responses of the tentative microwave filter satisfy the desired bandpass frequency responses. Only when the bandpass frequency responses of the tentative microwave filter satisfy the desired bandpass frequency responses, does the process proceed to step 409. Otherwise, the process proceeds to step 408. Note that the desired bandpass frequency responses have a certain amount of tolerance.

At step 408, the coupling coefficient function f(x) is calculated by formula (1):

$$f(x) \leftarrow f(x) + C_2 \cdot (f_{ex}(x) - f_s(x)) \quad (1)$$

where $C_2$ is a definite value more than −1 and less than 1 ($-1 < C_2 < 1$). Then, the processes at steps 404, 405, 406, 407 and 408 are repeated until the bandpass frequency responses of the tentative filter satisfy the desired bandpass frequency responses.

At step 409, actual microwave bandpass filters are manufactured in accordance with the layout designed at step 405, thus completing the flowchart of FIG. 4 at step 410.

In the manufacturing method as illustrated in FIGS. 3, 4 and 5, since the coupling coefficient function f(x) is changed step by step, it is easy for the obtained bandpass frequency responses of the filter to be converged into the desired bandpass frequency responses. Also, since the conclusively-manufactured layout is already converged to achieve the desired frequency responses, no additional operation such as the laser trimming operation or the adjustment of tuning screws is performed upon each of the actual microwave bandpass filters. Thus, the manufacturing cost can be decreased.

At step 408, a coupling coefficient function f(x) is calculated by formula (1); however, the following coupling coefficient functions $f_1(x)$, $f_2(x)$, $f_3(x)$, . . . are prepared and one of them can be selected.

$$f_1(x) = f_s(x) + 0.1 \cdot (f_{ex}(x) - f_s(x))$$

$$f_2 = f_s(x) - 0.1 \cdot (f_{ex}(x) - f_s(x))$$

$$f_3 = f_s(x) + 0.2 \cdot (f_{ex}(x) - f_s(x))$$

Further, when experimentally obtaining the experimental coupling coefficient function $f_{ex}(x)$, the experimental coupling coefficient function $f_{ex}(x)$ can be expected to be a function of $f_s(x)$ such as $$f_{ex}(x) = A + B \cdot f_s(x)$$

$$f_{ex}(x) = A + B \cdot f_s(x) + C \cdot f_s^2(x)$$

$$f_{ex}(x) = A + B \cdot f_s(x) + C \cdot f_s^2(x) + D \cdot f_s^3(x)$$

Figure 6:
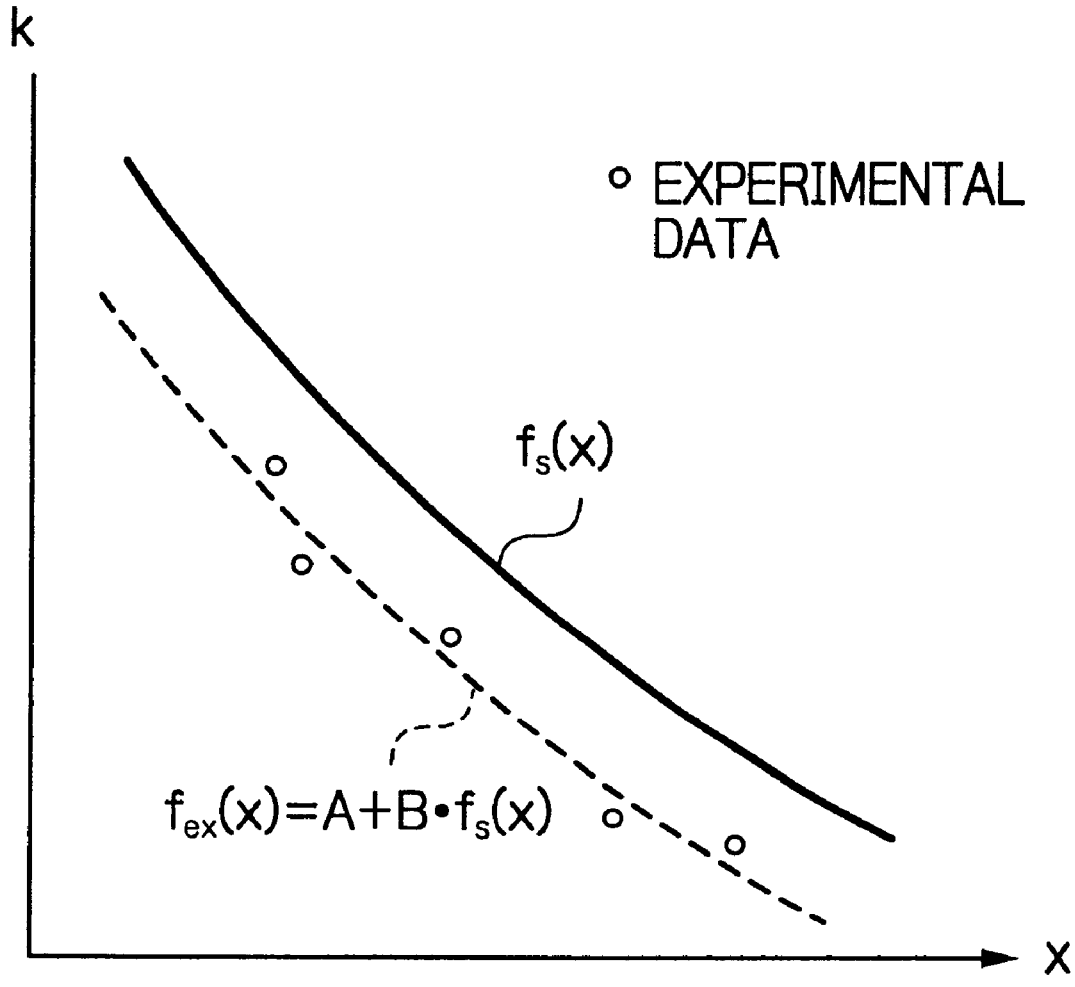
FIG. 6 is a graph for explaining a method for obtaining the coupling coefficient function of FIG. 5.

In this case, the coefficients A and B (A, B and C or A, B, C and D) are determined by the least square method as shown in FIG. 6.

The present invention can be applied to a Chebyshev type bandpass filter or a Butterworth type bandpass filter. Also, the present invention can be applied to filters other than bandpass filters.

According to the inventor's experiment, a microwave bandpass filter with 10-pole or more made of superconductor signal lines and a superconductor ground plane was obtained to have an unloaded Q-factor of about 100,000. Note that the above-mentioned superconductor can be a copper oxide superconductor including Y, Ba, Sr, Bi, Tl, Hg or Ag.

As explained hereinabove, according to the present invention, since the obtained bandpass frequency responses of the filter are easily converged into desired bandpass frequency responses and no additional operation is required for actual filters, the manufacturing cost can be decreased.

What is claimed is:

1. A method for manufacturing a filter including a plurality of resonators arranged in series, comprising the steps of;

determining a configuration of said resonators and a number of said resonators, so that an amount of additional coupling coefficients between said resonators except for two adjacent ones of said resonators is smaller than a predetermined value;

calculating an initial coupling coefficient function with respect to a distance between two adjacent ones of said resonators, after the configuration and number of said resonators are determined;

setting said initial coupling coefficient function in a coupling coefficient function;

calculating coupling coefficients between said resonators for desired filter frequency responses;

calculating distances between said resonators having said calculated coupling coefficients in accordance with said coupling coefficient function;

designing a layout of said filter having said resonators with said calculated distances;

manufacturing a tentative filter in accordance with said layout;

determining whether or not filter frequency responses of said tentative filter satisfy said desired filter frequency responses;

changing said coupling coefficient function when the filter frequency responses of said tentative filter do not satisfy said desired filter frequency responses, thus repeating said distance calculating step; and manufacturing actual filters in accordance with said layout when the filter frequency responses of said tentative filter satisfy said desired filter frequency responses.

2. The method as set forth in claim 1, wherein said predetermined value is dependent upon an amount of a main coupling coefficient between two adjacent ones of said resonators.

3. The method as set forth in claim 1, wherein said initial coupling coefficient function calculating step calculates said initial coupling coefficient function by using an electromagnetic simulation.

4. The method as set forth in claim 1, wherein said coupling coefficient function changing step changes said coupling coefficient function by:

$$f(x) \leftarrow f(x) + C_2 \cdot (f_{ex}(x) - f_s(x))$$

where x is a distance between said resonators;

f(x) is said coupling coefficient function;

$f_s(x)$ is said initial coupling coefficient function;

$f_{ex}(x)$ is an experimental coupling coefficient function; and $C_2$ is a definite value more than −1 and less than 1.

5. The method as set forth in claim 4, wherein said experimental coupling coefficient function is constructed by a smooth function based upon several experimental data.

6. The method as set forth in claim 5, wherein said smooth function is obtained by the least square method.

7. A method for manufacturing a microwave bandpass filter including a plurality of microstrip resonators arranged in series, comprising the steps of;

determining a configuration of said microstrip resonators and a number of said microstrip resonators, so that an amount of additional coupling coefficients between said microstrip resonators except for two adjacent ones of said microstrip resonators is smaller than a predetermined value;

calculating an initial coupling coefficient function with respect to a distance between two adjacent ones of said microstrip resonators, after the configuration and number of said microstrip resonators are determined;

setting said initial coupling coefficient function in a coupling coefficient function;

calculating coupling coefficients between said microstrip resonators for desired bandpass filter frequency responses;

calculating distances between said microstrip resonators having said calculated coupling coefficients in accordance with said coupling coefficient function;

designing a layout of said microwave bandpass filter having said resonators with said calculated distances;

manufacturing a tentative microwave bandpass filter in accordance with said layout;

determining whether or not bandpass filter frequency responses of said tentative microwave bandpass filter satisfy said desired filter frequency responses;

changing said coupling coefficient function when the filter frequency responses of said tentative microwave banpass filter do not satisfy said desired bandpass filter frequency responses, thus repeating said distance calculating step, said layout designing step and said bandpass filter frequency responses determining step; and manufacturing actual microwave bandpass filters in accordance with said layout when the filter frequency responses of said tentative microwave bandpass filter satisfy said desired filter frequency responses.

8. The method as set forth in claim 7, wherein said predetermined value is dependent upon an amount of a main coupling coefficient between two adjacent ones of said microstrip resonators.

9. The method as set forth in claim 7, wherein said initial coupling coefficient function calculating step calculates said initial coupling coefficient function by using a two-dimensional electromagnetic simulation.

10. The method as set forth in claim 7, wherein said coupling coefficient junction changing step changes said coupling coefficient function by:

$$f(x) \leftarrow f(x) + C_2 \cdot (f_{ex}(x) - f_s(x))$$

where x is a distance between said resonators;

f(x) is said coupling coefficient function;

$f_s(x)$ is said initial coupling coefficient function;

$f_{ex}(x)$ is an experimental coupling coefficient function; and $C_2$ is a definite value more than −1 and less than 1.

11. The method as set forth in claim 9, wherein said experimental coupling coefficient function is constructed by a smooth function based upon several experimental data.

12. The method as set forth in claim 11, wherein said smooth function is obtained by the least square method.

* * * * *